US011441333B2

(12) United States Patent
Tagtow et al.

(10) Patent No.: US 11,441,333 B2
(45) Date of Patent: Sep. 13, 2022

(54) ELECTRONIC DEADBOLT SYSTEMS

(71) Applicant: Amesbury Group, Inc., Amesbury, MA (US)

(72) Inventors: Gary E. Tagtow, Sioux Falls, SD (US); Michael Lee Anderson, Sioux Falls, SD (US); Tracy Lammers, Sioux Falls, SD (US); Bruce Hagemeyer, Pella, IA (US); Douglas John Criddle, Sioux Falls, SD (US)

(73) Assignee: Amesbury Group, Inc., Edina, MN (US)

( * ) Notice: Subject to any disclaimer, the term of this patent is extended or adjusted under 35 U.S.C. 154(b) by 855 days.

(21) Appl. No.: 16/299,333

(22) Filed: Mar. 12, 2019

(65) Prior Publication Data

US 2019/0277062 A1 Sep. 12, 2019

Related U.S. Application Data

(60) Provisional application No. 62/641,511, filed on Mar. 12, 2018.

(51) Int. Cl.
*E05B 47/02* (2006.01)
*E05B 47/00* (2006.01)
(Continued)

(52) U.S. Cl.
CPC ..... *E05B 47/023* (2013.01); *E05B 47/0012* (2013.01); *G07C 9/00174* (2013.01);
(Continued)

(58) Field of Classification Search
CPC ..... E05B 47/023; E05B 47/0012; E05B 2047/0014; E05B 2047/0023;
(Continued)

(56) References Cited

U.S. PATENT DOCUMENTS 333,093 A 12/1885 Wright
419,384 A 1/1890 Towne
(Continued)

FOREIGN PATENT DOCUMENTS

AU 84928 12/2020
CA 2631521 11/2009
(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.
(Continued)

*Primary Examiner* — Lloyd A Gall
(74) *Attorney, Agent, or Firm* — Merchant & Gould P.C.

(57) ABSTRACT

An electronic deadbolt includes a face plate and a housing having a first end and an opposite second end. The first end is releasably coupled to the face plate, and the housing further includes a bolt compartment defining a bolt axis and a battery compartment defining a battery axis. The bolt axis is substantially parallel to and offset from the battery axis, and the bolt compartment is separated from the battery compartment proximate the second end of the housing. The electronic deadbolt further includes a bolt module disposed within the bolt compartment. The bolt module includes a motor and a deadbolt, and the deadbolt is configured to be selectively linearly extended from the face plate along the bolt axis.

20 Claims, 8 Drawing Sheets

(51) Int. Cl.
*E05B 9/00* (2006.01)
*G07C 9/00* (2020.01)

(52) U.S. Cl.
CPC ..... *E05B 2047/0014* (2013.01); *G07C 2009/00642* (2013.01)

(58) Field of Classification Search
CPC ..... E05B 47/026; E05B 2047/0058; E05B 9/002; E05B 15/00; E05B 47/00; G07C 9/00174; G07C 2009/00642; Y10T 70/7062; Y10T 70/7102; Y10T 70/7107; Y10T 70/7113; Y10T 70/7119; Y10T 70/7124; Y10T 70/8514; Y10T 292/1021; Y10T 292/1033
See application file for complete search history.

(56) References Cited

U.S. PATENT DOCUMENTS 651,947 A 6/1900 Johnson
738,280 A 9/1903 Bell et al.
932,330 A 8/1909 Rotchford
958,880 A 5/1910 Lawson
966,208 A 8/1910 Hoes
972,769 A 10/1910 Lark
980,131 A 12/1910 Shean
998,642 A 7/1911 Shean
1,075,914 A 10/1913 Hoes
1,094,143 A 4/1914 Hagstrom
1,142,463 A 6/1915 Shepherd
1,174,652 A 3/1916 Banks
1,247,052 A 11/1917 Wilson
1,251,467 A 1/1918 Blixt et al.
1,277,174 A 8/1918 Bakst
1,359,347 A 11/1920 Fleisher
1,366,909 A 2/1921 Frommer
1,368,141 A 2/1921 Hagstrom
1,529,085 A 3/1925 Preble
1,574,023 A 2/1926 Crompton et al.
1,596,992 A 8/1926 Ognowicz
1,646,674 A 10/1927 Angelillo
1,666,654 A 4/1928 Hiering
1,716,113 A 6/1929 Carlson
1,974,253 A 9/1934 Sandor
2,535,947 A 12/1950 Newell
2,729,089 A 1/1956 Pelcin
2,739,002 A 3/1956 Johnson
2,862,750 A 12/1958 Minke
2,887,336 A 5/1959 Meyer
2,905,493 A 9/1959 Tocchetto
3,064,462 A 11/1962 Ng et al.
3,083,560 A 4/1963 Scott
3,124,378 A 3/1964 Jackson
3,162,472 A 12/1964 Rust
3,214,947 A 11/1965 Wikkerink
3,250,100 A 5/1966 Cornaro
3,332,182 A 7/1967 Mark
3,378,290 A 4/1968 Sekulich
3,413,025 A 11/1968 Sperry
3,437,364 A 4/1969 Walters
RE26,677 E 10/1969 Russell et al.
3,498,657 A 3/1970 Fontana
3,578,368 A 5/1971 Dupuis
3,586,360 A 6/1971 Perrotta
3,617,080 A 11/1971 Miller
3,670,537 A 6/1972 Horgan, Jr.
3,792,884 A 2/1974 Tutikawa
3,806,171 A 4/1974 Fernandez
3,899,201 A 8/1975 Paioletti
3,904,229 A 9/1975 Waldo
3,919,808 A 11/1975 Simmons
3,933,382 A * 1/1976 Counts ..... E05B 83/12 292/201
3,940,886 A 3/1976 Ellingson, Jr.
3,953,061 A 4/1976 Hansen et al.
4,076,289 A 2/1978 Fellows et al.
4,116,479 A 9/1978 Poe
4,130,306 A 12/1978 Brkic
4,132,438 A 1/1979 Guymer
4,135,377 A 1/1979 Kleefeldt
4,146,994 A 4/1979 Williams
4,236,396 A 12/1980 Surko et al.
4,273,368 A 6/1981 Tanaka
4,283,882 A 8/1981 Hubbard
4,288,944 A 9/1981 Donovan
4,362,328 A 12/1982 Tacheny
4,365,490 A 12/1982 Manzoni
4,372,594 A 2/1983 Gater
4,476,700 A 10/1984 King
4,500,122 A 2/1985 Douglas
4,547,006 A 10/1985 Castanier
4,548,432 A 10/1985 Bengtsson
4,593,542 A 6/1986 Rotondi et al.
4,595,220 A 6/1986 Hatchett, Jr.
4,602,490 A 7/1986 Glass
4,602,812 A 7/1986 Bourne
4,607,510 A 8/1986 Shanaan et al.
4,633,688 A 1/1987 Beudat
4,639,025 A 1/1987 Fann
4,643,005 A 2/1987 Logas
4,691,543 A 9/1987 Watts
4,704,880 A 11/1987 Schlindwein
4,717,909 A 1/1988 Davis
4,754,624 A 7/1988 Fleming et al.
4,768,817 A 9/1988 Fann
4,799,719 A * 1/1989 Wood ..... E05B 47/0012 292/144
4,893,849 A 1/1990 Schlack
4,913,475 A 4/1990 Bushnell et al.
4,949,563 A 8/1990 Gerard et al.
4,961,602 A 10/1990 Pettersson
4,962,653 A 10/1990 Kaup
4,962,800 A 10/1990 Wo
4,964,660 A 10/1990 Prevot et al.
4,973,091 A 11/1990 Paulson
5,077,992 A 1/1992 Su
5,092,144 A 3/1992 Fleming et al.
5,114,192 A 5/1992 Toledo
5,118,151 A 6/1992 Nicholas, Jr. et al.
5,125,703 A 6/1992 Clancy et al.
5,148,691 A 9/1992 Wallden
5,171,050 A 12/1992 Mascotte
5,172,944 A 12/1992 Munich et al.
5,184,852 A 2/1993 O'Brien
5,193,861 A 3/1993 Juga
5,197,771 A 3/1993 Kaup et al.
5,257,841 A 11/1993 Geringer
5,265,452 A 11/1993 Dawson et al.
5,290,077 A 3/1994 Fleming
5,364,138 A 11/1994 Dietrich
5,373,716 A 12/1994 MacNeil et al.
5,382,060 A 1/1995 O'Toole et al.
5,388,875 A 2/1995 Fleming
5,394,718 A 3/1995 Hotzi
5,404,737 A 4/1995 Hotzl
5,441,315 A 8/1995 Kleefeldt
5,456,503 A 10/1995 Russell et al.
5,482,334 A 1/1996 Hotzl
5,495,731 A 3/1996 Riznik
5,496,082 A 3/1996 Zuckerman
5,498,038 A 3/1996 Simon
5,513,505 A 5/1996 Danes
5,516,160 A 5/1996 Kajuch
5,524,941 A 6/1996 Fleming
5,524,942 A 6/1996 Fleming
5,544,924 A 8/1996 Paster
5,546,777 A * 8/1996 Liu ..... E05C 1/06 292/DIG. 60
5,603,534 A 2/1997 Fuller
5,609,372 A 3/1997 Ponelle
5,620,216 A 4/1997 Fuller
5,707,090 A 1/1998 Sedley
5,716,154 A 2/1998 Miller et al.

(56) References Cited

U.S. PATENT DOCUMENTS 5,722,704 A 3/1998 Chaput et al.
5,728,108 A 3/1998 Griffiths et al.
5,735,559 A 4/1998 Frolov
5,757,269 A 5/1998 Roth
5,782,114 A 7/1998 Zeus et al.
5,791,179 A * 8/1998 Brask ..... E05B 47/0669 292/144
5,791,700 A 8/1998 Biro
5,820,170 A 10/1998 Clancy
5,820,173 A 10/1998 Fuller
5,825,288 A 10/1998 Wojdan
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,911,460 A * 6/1999 Hawkins ..... E05B 63/248 292/144
5,911,763 A 6/1999 Quesada
5,915,764 A 6/1999 MacDonald
5,918,916 A 7/1999 Kajuch
5,931,430 A 8/1999 Palmer
5,946,956 A 9/1999 Hotzl
5,951,068 A 9/1999 Strong et al.
5,979,199 A 11/1999 Elpern
6,050,115 A 4/2000 Schroter et al.
6,079,585 A 6/2000 Lentini
6,089,058 A 7/2000 Elpern
6,094,869 A 8/2000 Magoon et al.
6,098,433 A 8/2000 Manaici
6,112,563 A 9/2000 Ramos
6,116,067 A 9/2000 Myers
6,119,538 A * 9/2000 Chang ..... E05B 81/25 74/411
6,120,071 A 9/2000 Picard
D433,916 S 11/2000 Frey
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 11/2001 Kang
6,327,881 B1 12/2001 Grundler et al.
6,389,855 B2 5/2002 Renz et al.
6,441,735 B1 8/2002 Marko
6,443,506 B1 9/2002 Su
6,453,616 B1 9/2002 Wright
6,454,322 B1 9/2002 Su
6,457,751 B1 10/2002 Hartman
6,490,895 B1 12/2002 Weinerman
6,494,680 B2 12/2002 Cardin et al.
6,502,435 B2 1/2003 Watts et al.
6,516,641 B1 2/2003 Segawa
6,540,268 B2 4/2003 Pauser
6,564,596 B2 5/2003 Huang
6,568,726 B1 5/2003 Caspi
6,580,355 B1 6/2003 Milo
6,619,085 B1 9/2003 Hsieh
6,637,784 B1 10/2003 Hauber et al.
6,672,632 B1 1/2004 Speed et al.
6,688,656 B1 2/2004 Becken
6,733,051 B1 5/2004 Cowper
6,776,441 B2 8/2004 Liu
6,810,699 B2 11/2004 Nagy
6,813,916 B2 11/2004 Chang
6,871,451 B2 3/2005 Harger et al.
6,905,152 B1 6/2005 Hudson
6,929,293 B2 8/2005 Tonges
6,935,662 B1 8/2005 Hauber et al.
6,962,377 B2 11/2005 Tonges
6,971,686 B2 12/2005 Becken
6,994,383 B2 2/2006 Morris
7,000,959 B2 2/2006 Sanders
7,010,945 B2 3/2006 Yu
7,010,947 B2 3/2006 Milo
7,025,394 B1 4/2006 Hunt
7,032,418 B2 4/2006 Martin
7,052,054 B2 5/2006 Luker
7,083,206 B1 8/2006 Johnson
7,128,350 B2 10/2006 Eckerdt
7,152,441 B2 12/2006 Friar
7,155,946 B2 1/2007 Lee et al.
7,203,445 B2 4/2007 Uchida
7,207,199 B2 4/2007 Smith et al.
7,249,791 B2 7/2007 Johnson
7,261,330 B1 8/2007 Hauber
7,353,637 B2 4/2008 Harger et al.
7,404,306 B2 7/2008 Walls et al.
7,410,194 B2 8/2008 Chen
7,418,845 B2 9/2008 Timothy
7,513,540 B2 4/2009 Hagemeyer et al.
7,526,933 B2 5/2009 Meekma
7,634,928 B2 12/2009 Hunt
7,637,540 B2 12/2009 Chiang
7,677,067 B2 3/2010 Riznik et al.
7,686,207 B1 3/2010 Jeffs
7,707,862 B2 5/2010 Walls et al.
7,726,705 B2 6/2010 Kim
7,735,882 B2 6/2010 Abdollahzadeh et al.
7,748,759 B2 7/2010 Chen
7,856,856 B2 12/2010 Shvartz
7,878,034 B2 2/2011 Alber et al.
7,946,080 B2 5/2011 Ellerton et al.
7,963,573 B2 6/2011 Blomqvist
8,161,780 B1 4/2012 Huml
8,182,002 B2 5/2012 Fleming
8,325,039 B2 12/2012 Picard
8,348,308 B2 1/2013 Hagemeyer et al.
8,376,414 B2 2/2013 Nakanishi et al.
8,376,415 B2 2/2013 Uyeda
8,382,166 B2 2/2013 Hagemeyer et al.
8,382,168 B2 2/2013 Carabalona
8,398,126 B2 3/2013 Nakanishi et al.
8,403,376 B2 3/2013 Greiner
8,550,506 B2 10/2013 Nakanishi
8,567,631 B2 10/2013 Brunner
8,628,126 B2 1/2014 Hagemeyer et al.
8,646,816 B2 2/2014 Dziurdzia
8,839,562 B2 9/2014 Madrid
8,840,153 B2 9/2014 Juha
8,850,744 B2 10/2014 Bauman et al.
8,851,532 B2 10/2014 Gerninger
8,876,172 B2 11/2014 Denison
8,899,635 B2 12/2014 Nakanishi
8,922,370 B2 12/2014 Picard
8,939,474 B2 1/2015 Hagemeyer et al.
9,428,937 B2 8/2016 Tagtow et al.
9,482,035 B2 11/2016 Wolf
9,512,654 B2 12/2016 Armari et al.
9,605,444 B2 3/2017 Rickenbaugh
9,637,957 B2 5/2017 Hagemeyer et al.
9,758,997 B2 9/2017 Hagemeyer et al.
9,765,550 B2 9/2017 Hemmingsen et al.
9,790,716 B2 10/2017 Hagemeyer et al.
9,822,552 B2 11/2017 Eller et al.
10,087,656 B1 10/2018 Cannella
10,174,522 B2 1/2019 Denison
10,240,366 B2 3/2019 Sotes Delgado
10,246,914 B2 4/2019 Sieglaar
10,273,718 B2 4/2019 Cannella
10,400,477 B2 9/2019 Moon
10,487,544 B2 11/2019 Ainley
10,662,675 B2 * 5/2020 Tagtow ..... E05B 9/002
10,738,506 B2 8/2020 Holmes
10,822,836 B2 11/2020 Nakasone
10,968,661 B2 * 4/2021 Tagtow ..... E05B 47/0012

(56) References Cited

U.S. PATENT DOCUMENTS

| | | | |
|---|---|---|---|
| 11,021,892 | B2 * | 6/2021 | Tagtow ..... E05B 47/026 |
| 2002/0104339 | A1 | 8/2002 | Saner |
| 2003/0024288 | A1 | 2/2003 | Gokcebay et al. |
| 2003/0159478 | A1 | 8/2003 | Nagy |
| 2004/0004360 | A1 | 1/2004 | Huang |
| 2004/0011094 | A1 | 1/2004 | Hsieh |
| 2004/0066046 | A1 | 4/2004 | Becken |
| 2004/0089037 | A1 | 5/2004 | Chang |
| 2004/0107746 | A1 | 6/2004 | Chang |
| 2004/0107747 | A1 | 6/2004 | Chang |
| 2004/0112100 | A1 | 6/2004 | Martin |
| 2004/0145189 | A1 | 7/2004 | Liu |
| 2004/0227349 | A1 | 11/2004 | Denys |
| 2004/0239121 | A1 | 12/2004 | Morris |
| 2005/0029345 | A1 | 2/2005 | Waterhouse |
| 2005/0044908 | A1 | 3/2005 | Min |
| 2005/0050928 | A1 | 3/2005 | Frolov |
| 2005/0103066 | A1 | 5/2005 | Botha et al. |
| 2005/0144848 | A1 | 7/2005 | Harger et al. |
| 2005/0166647 | A1 | 8/2005 | Walls |
| 2005/0180562 | A1 | 8/2005 | Chiang |
| 2005/0229657 | A1 | 10/2005 | Johansson et al. |
| 2006/0043742 | A1 | 3/2006 | Huang |
| 2006/0071478 | A1 | 4/2006 | Denys |
| 2006/0076783 | A1 | 4/2006 | Tsai |
| 2006/0150516 | A1 | 7/2006 | Hagemeyer |
| 2006/0208509 | A1 | 9/2006 | Bodily |
| 2007/0068205 | A1 | 3/2007 | Timothy |
| 2007/0080541 | A1 | 4/2007 | Fleming |
| 2007/0113603 | A1 | 5/2007 | Polster |
| 2007/0170725 | A1 | 7/2007 | Speyer et al. |
| 2007/0259551 | A1 | 11/2007 | Rebel |
| 2008/0000276 | A1 | 1/2008 | Huang |
| 2008/0001413 | A1 | 1/2008 | Lake |
| 2008/0087052 | A1 | 4/2008 | Abdollahzadeh et al. |
| 2008/0092606 | A1 | 4/2008 | Meekma |
| 2008/0093110 | A1 | 4/2008 | Bagung |
| 2008/0141740 | A1 | 6/2008 | Shvartz |
| 2008/0150300 | A1 | 6/2008 | Harger et al. |
| 2008/0156048 | A1 | 7/2008 | Topfer |
| 2008/0156049 | A1 | 7/2008 | Topfer |
| 2008/0157544 | A1 | 7/2008 | Phipps |
| 2008/0178530 | A1 | 7/2008 | Ellerton et al. |
| 2008/0179893 | A1 | 7/2008 | Johnson |
| 2008/0184749 | A1 | 8/2008 | Alber et al. |
| 2008/0191499 | A1 | 8/2008 | Stein |
| 2009/0064737 | A1 | 3/2009 | Fan |
| 2009/0078011 | A1 | 3/2009 | Avni |
| 2009/0218832 | A1 | 9/2009 | Mackle |
| 2009/0314042 | A1 | 12/2009 | Fan |
| 2009/0315669 | A1 | 12/2009 | Lang |
| 2010/0107707 | A1 | 5/2010 | Viviano |
| 2010/0154490 | A1 | 6/2010 | Hagemeyer et al. |
| 2010/0213724 | A1 | 8/2010 | Uyeda |
| 2010/0236302 | A1 | 9/2010 | Uyeda |
| 2010/0313612 | A1 | 12/2010 | Eichenstein |
| 2010/0327610 | A1 | 12/2010 | Nakanishi et al. |
| 2011/0056254 | A1 | 3/2011 | Tsai |
| 2011/0198867 | A1 | 8/2011 | Hagemeyer et al. |
| 2011/0289987 | A1 | 12/2011 | Chiou et al. |
| 2011/0314877 | A1 | 12/2011 | Fang |
| 2012/0001443 | A1 | 1/2012 | Mitchell |
| 2012/0146346 | A1 | 6/2012 | Hagemeyer et al. |
| 2012/0235428 | A1 | 9/2012 | Blacklaws et al. |
| 2012/0306220 | A1 | 12/2012 | Hagemeyer et al. |
| 2013/0019643 | A1 | 1/2013 | Tagtow et al. |
| 2013/0081251 | A1 | 4/2013 | Hultberg |
| 2013/0140833 | A1 | 6/2013 | Hagemeyer et al. |
| 2013/0152647 | A1 | 6/2013 | Terei et al. |
| 2013/0200636 | A1 | 8/2013 | Hagemeyer et al. |
| 2013/0234449 | A1 | 9/2013 | Dery et al. |
| 2013/0276488 | A1 | 10/2013 | Haber |
| 2014/0060127 | A1 | 3/2014 | Hemmingsen et al. |
| 2014/0125068 | A1 | 5/2014 | Hagemeyer et al. |
| 2014/0159387 | A1 | 6/2014 | Hagemeyer et al. |
| 2014/0182343 | A1 | 7/2014 | Talpe |
| 2014/0367978 | A1 | 12/2014 | Geringer |
| 2015/0075233 | A1 | 3/2015 | Pluta |
| 2015/0089804 | A1 | 4/2015 | Picard |
| 2015/0114176 | A1 | 4/2015 | Bisang |
| 2015/0170449 | A1 | 6/2015 | Chandler, Jr. |
| 2015/0176311 | A1 | 6/2015 | Picard |
| 2015/0252595 | A1 | 9/2015 | Hagemeyer et al. |
| 2016/0083976 | A1 | 3/2016 | Rickenbaugh |
| 2016/0108650 | A1 | 4/2016 | Hagemeyer et al. |
| 2016/0369525 | A1 | 12/2016 | Tagtow et al. |
| 2018/0023320 | A1 | 1/2018 | McKibben |
| 2018/0051478 | A1 | 2/2018 | Tagtow |
| 2018/0051480 | A1 | 2/2018 | Tagtow |
| 2018/0119462 | A1 | 5/2018 | Hagemeyer |
| 2018/0155962 | A1 | 6/2018 | Mitchell et al. |
| 2018/0298642 | A1 | 10/2018 | Tagtow |
| 2018/0313116 | A1 | 11/2018 | Criddle |
| 2019/0024437 | A1 | 1/2019 | Tagtow |
| 2019/0032368 | A1 | 1/2019 | Welbig |
| 2020/0354990 | A1 | 11/2020 | Tagtow |
| 2020/0370338 | A1 | 11/2020 | Holmes |

FOREIGN PATENT DOCUMENTS

| | | | |
|---|---|---|---|
| CN | 1243908 | | 2/2000 |
| CN | 2554288 | Y | 6/2003 |
| CN | 2595957 | Y | 12/2003 |
| CN | 2660061 | | 12/2004 |
| CN | 201031548 | Y | 3/2008 |
| CN | 202047652 | U | 11/2011 |
| DE | 1002656 | | 2/1957 |
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 20115378 | U1 | 11/2001 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 0268750 | | 6/1988 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1283318 | | 2/2003 |
| EP | 1449994 | | 8/2004 |
| EP | 1574642 | | 9/2005 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2450509 | | 5/2012 |
| EP | 2581531 | A1 | 4/2013 |
| EP | 2584123 | A1 | 4/2013 |
| EP | 2584124 | A2 | 4/2013 |
| EP | 2998483 | | 3/2016 |
| EP | 3091152 | A1 | 11/2016 |
| FR | 363424 | | 7/1906 |
| FR | 370890 | | 2/1907 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 7/1977 |
| FR | 2342390 | | 9/1977 |
| FR | 2344695 | | 10/1977 |
| FR | 2502673 | | 10/1982 |
| FR | 2848593 | | 2/2005 |
| FR | 3017641 | | 8/2015 |
| GB | 226170 | | 4/1925 |

(56) References Cited

FOREIGN PATENT DOCUMENTS

| | | | |
|---|---|---|---|
| GB | 264373 | A | 1/1927 |
| GB | 583655 | | 12/1946 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| JP | 64-083777 | | 3/1989 |
| JP | 2003343141 | | 12/2003 |
| JP | 2006112042 | | 4/2006 |
| JP | 2008002203 | | 1/2008 |
| KR | 2011094706 | | 8/2011 |
| NL | 8105627 | | 7/1983 |
| SE | 309372 | | 3/1969 |
| WO | 96/25576 | | 8/1996 |
| WO | 97/41323 | | 11/1997 |
| WO | 02/33202 | | 4/2002 |
| WO | 2007/104499 | | 9/2007 |
| WO | 2009/059112 | | 5/2009 |
| WO | 2010071886 | | 6/2010 |
| WO | 2015/079290 | | 6/2015 |
| WO | 2020/023652 | | 1/2020 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"UPVC Window Hardware and uPVC Door Hardware online", http://www.upvc-hardware.co.uk/, accessed Oct. 27, 2011, original publication date unknown, 2 pgs.

Doorking.com—Electric Locks—Strikes and Deadbolts; printed from https://www.doorking.com/access-control/electricocks-strikes-deadbolts, 2 pages, Feb. 2016.

magneticlocks.net—Electric Strikes and Deadbolts; printed from https://www.magneticlocks.net/electric-strikes-and-deadbolts/electric-strikes.html, 8 pages, Feb. 2016.

sdcsecurity.com—Latch and Deadbolt Monitoring Strikes; printed from http://www.sdcsecurity.com/monitor-strike-kits2.htm, 2 pages, Feb. 2016.

* cited by examiner

ELECTRONIC DEADBOLT SYSTEMS

CROSS-REFERENCE TO RELATED APPLICATIONS

This application claims priority to and the benefit of U.S. Provisional Patent Application No. 62/641,511, filed on Mar. 12, 2018, the disclosure of which is hereby incorporated herein by reference in its entirety.

INTRODUCTION

Deadbolts are typically operated by a user (e.g., with a key on an outside of the door or a thumbturn on the inside of the door) to secure a door against unwanted intrusions. At least some known deadbolts are motorized, but it can often be difficult to install these systems within doors, as well as deliver reliable power.

SUMMARY

In an aspect, the technology relates to an electronic deadbolt including: a face plate; a housing including a first end and an opposite second end, wherein the first end is releasably coupled to the face plate, wherein the housing further includes a bolt compartment defining a bolt axis and a battery compartment defining a battery axis, and wherein the bolt axis is substantially parallel to and offset from the battery axis, and the bolt compartment is separated from the battery compartment proximate the second end of the housing; and a bolt module disposed within the bolt compartment, wherein the bolt module includes a motor and a deadbolt, and wherein the deadbolt is configured to be selectively linearly extended from the face plate along the bolt axis.

In an example, both of the bolt compartment and the battery compartment are substantially cylindrical. In another example, the bolt compartment has a first outer diameter and the battery compartment has a second outer diameter, and the first outer diameter is approximately equal to the second outer diameter. In yet another example, the bolt compartment and the battery compartment are approximately 1¼ inches in diameter. In still another example, the housing further includes a spacer disposed at least partially between the bolt compartment and the battery compartment at the first end. In an example, the bolt module further includes a lead screw configured to be rotated by the motor about the bolt axis, and the deadbolt is coupled to the lead screw.

In another example, the bolt module further includes a support coupled to an inside surface of the bolt compartment, wherein the support is engaged with the deadbolt such that upon rotation of the lead screw, rotation of the deadbolt is prevented so that rotational movement of the lead screw is transferred into linear movement of the deadbolt. In yet another example, the support at least partially supports the motor and the deadbolt within the bolt compartment. In still another example, a substantially cylindrical cover is threadably coupled to the face plate adjacent the battery compartment.

In another aspect, the technology relates to an electronic deadbolt including: a bolt compartment having a bolt axis and configured to house a bolt module, wherein the bolt module includes: a motor; a lead screw configured to be rotated by the motor about the bolt axis; and a deadbolt coupled to the lead screw and upon rotation of the lead screw, is linearly extendable from the bolt compartment along the bolt axis; a battery compartment having a battery axis and configured to house a battery module, wherein the bolt axis is substantially parallel to and offset from the battery axis; and a face plate releasably coupled to the bolt compartment and the battery compartment.

In an example, the bolt compartment and the battery compartment are coupled together to form a single housing. In another example, at least a portion of the bolt compartment and the battery compartment are separated by a gap. In yet another example, both of the bolt compartment and the battery compartment are substantially cylindrical. In still another example, the bolt compartment has a first outer diameter and the battery compartment has a second outer diameter, and the first outer diameter is approximately equal to the second outer diameter. In an example, the bolt compartment is independent from the battery compartment.

In another example, the face plate includes a shoulder extending therefrom and the compartments include a lip, and when the compartments are coupled to the face plate the shoulder engages with the lip. In yet another example, the bolt compartment and the battery compartment are coupled to the face plate with a snap-fit connection. In still another example, the bolt module further includes a position sensor.

In another aspect, the technology relates to a method of installing an electronic deadbolt on a door, the method including: boring two substantially cylindrical holes adjacent to one another on the door; inserting at least a portion of the electronic deadbolt into the two cylindrical holes, wherein the electronic deadbolt includes a face plate and a housing including a bolt compartment and a battery compartment, wherein each compartment is inserted within a respective hole, and wherein a bolt module is disposed within the bolt compartment and a battery module is disposed within the battery compartment; and securing the face plate to the door.

In an example, the method further includes inserting a power source into the battery compartment.

BRIEF DESCRIPTION OF THE DRAWINGS

There are shown in the drawings, examples that are presently preferred, it being understood, however, that the technology is not limited to the precise arrangements and instrumentalities shown.

DETAILED DESCRIPTION

Figure 1:
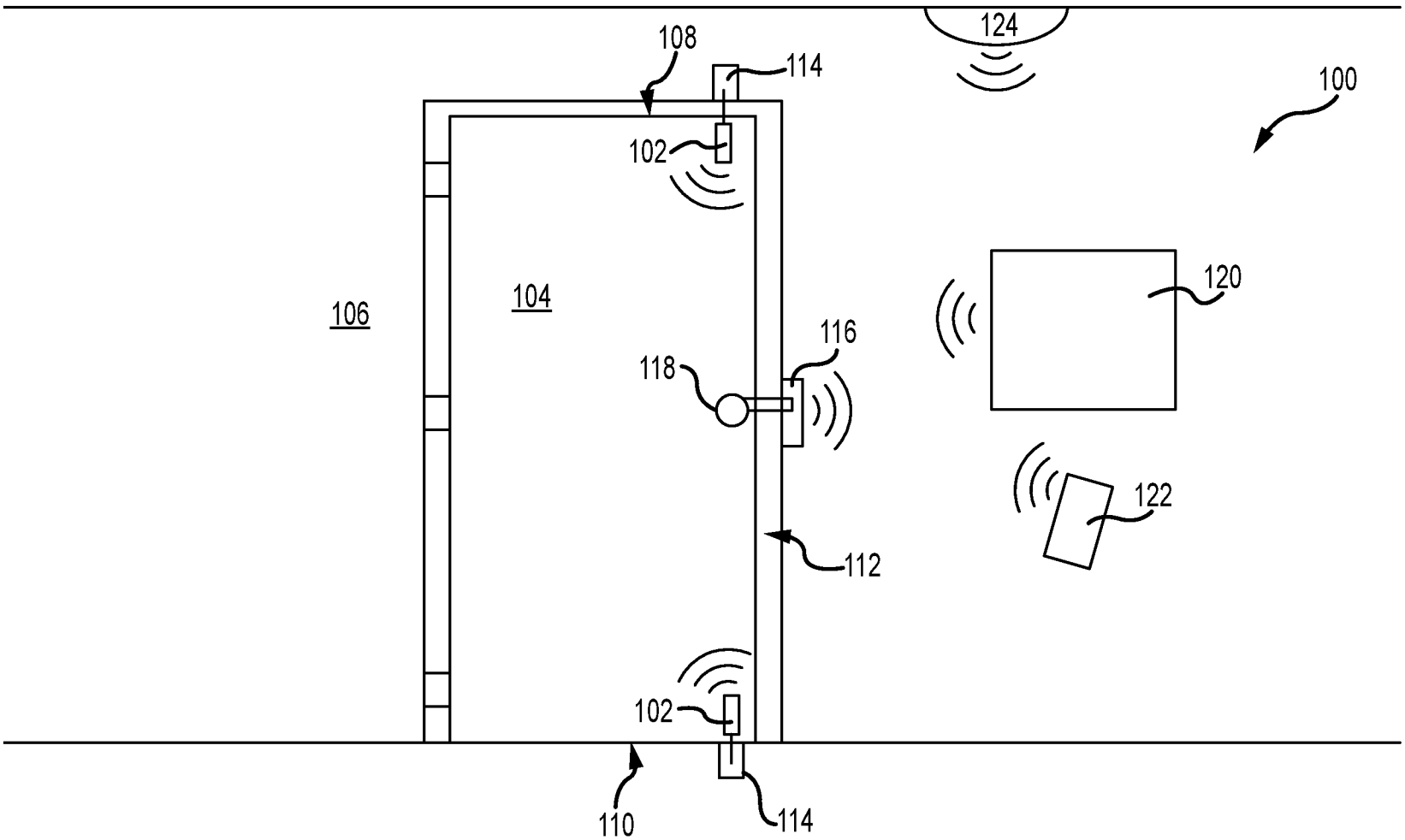
FIG. 1 depicts a schematic view of an electronic door lock system.

FIG. 1 depicts a schematic view of one example of a multi-point electric door lock system 100. The system 100 includes two electronic deadbolt systems 102 installed in a door panel 104, for example, so as to extend into a portion of a frame 106 such as a head and/or a sill thereof. In other examples, the electronic deadbolt system 102 may be installed within a locking edge of the door panel 104 so as to extend into a vertical portion (e.g., jamb wall) of the frame 106 between the head and the sill. Alternatively, the electronic deadbolt system 102 may be installed in the frame 106 so as to extend into the door 104. Additionally, the placement and number of electronic deadbolt systems 102 may be altered as required or desired for a particular application, for example, in pivoting doors, the electronic deadbolts may be disposed so as to extend from a head 108, a sill 110, or a locking edge 112 of the door 104.

In the example, the door panel 104 is a pivoting door; however, the electronic deadbolt systems described herein can be utilized in entry doors, sliding doors, pivoting patio doors, and any other door as required or desired. In sliding patio doors, the electronic deadbolts 102 have linearly extending locking elements that may extend from the head 108 or the sill 110 of the sliding door. If utilized on the locking edge 112 of a sliding door, the electronic deadbolt 102 would require a hook-shaped locking element that would hook about a keeper so as to prevent retraction of the door.

In the example, each electronic deadbolt system 102 is positioned to as to extend into a keeper 114. The keepers 114 may be standard keepers or electronic keepers as described in U.S. patent application Ser. No. 15/239,714, filed Aug. 17, 2016, entitled "Locking System Having an Electronic Keeper" the disclosure of which is herein incorporated by reference in its entirety. The system 100 also includes an electronic keeper 116 configured to receive a standard (e.g., manually-actuated) deadbolt 118, as typically available on an entry or patio door.

In one example, once the deadbolt 118 is manually actuated into the locking position, the electronic keeper 116 detects a position of the deadbolt 118 therein. A signal may be sent to the remotely located electronic deadbolt systems 102, thus causing actuation thereof. At this point, the door 104 is now locked at multiple points. Unlocking of the manual deadbolt 118 is detected by the electronic keeper 116 (that is, the keeper 116 no longer detects the presence of the deadbolt 118 therein) and a signal is sent to the remote electronic deadbolts 102 causing retraction thereof, thus allowing the door 104 to be opened. Thus, the electronic deadbolts described herein may be utilized to create a robust multi-point locking system for a door and to improve the security thereof.

In another example, the system 100 may include a controller/monitoring system, which may be a remote panel 120, which may be used to extend or retract the electronic deadbolt systems 102, or which may be used for communication between the various electronic keepers 114 and deadbolts 102. Alternatively or additionally, an application on a remote computer or smartphone 122 may take the place of, or supplement, the remote panel 120. By utilizing a remote panel 120 and/or a smartphone 122, the electronic deadbolt systems 102 may be locked or unlocked remotely, thus providing multi-point locking ability without the requirement for manual actuation of the deadbolt 118. Additionally, any or all of the components (electronic deadbolt system 102, keeper 116, panel 120, and smartphone 122) may communicate either directly or indirectly with a home monitoring or security system 124. The communication between components may be wireless, as depicted, or may be via wired systems.

The electronic deadbolts described herein are configured to be more easily installed within the door 104 and/or frame 106. Some known electronic deadbolts have a non-cylindrical shapes that require complex cavities to be formed in the door and/or frame. This increases the difficulty of installation of the electronic deadbolt. In one example, the electronic deadbolts described herein include a bolt module and a separate battery module that are each disposed within cylindrical housings. These cylindrical housings enable typical boring tools (e.g., a drill and a bit) to be used to install the electronic deadbolts on the edge of the door. For example, the cylindrical housings may correspond in shape and size of the manual deadbolt so that the tools utilized to install the manual deadbolt can be used to install the electronic deadbolts. Accordingly, a more efficient installation of the remote electronic deadbolts is enabled, even by untrained purchasers. Furthermore, the electronic deadbolt described herein is constructed and configured in a manner that reduces overall space and limits end-user access to internal components.

Figure 2A:
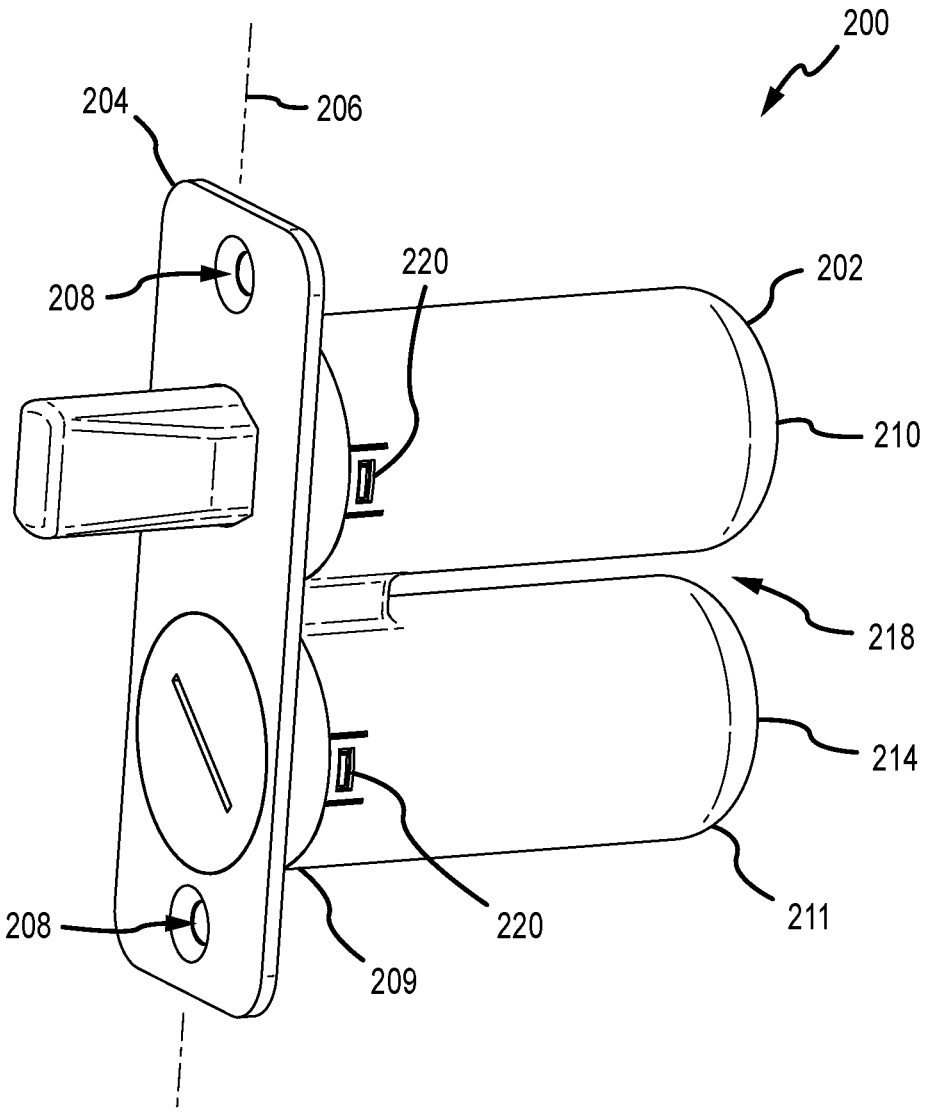
FIG. 2A is a front perspective view of an exemplary electronic deadbolt.
Figure 2B:
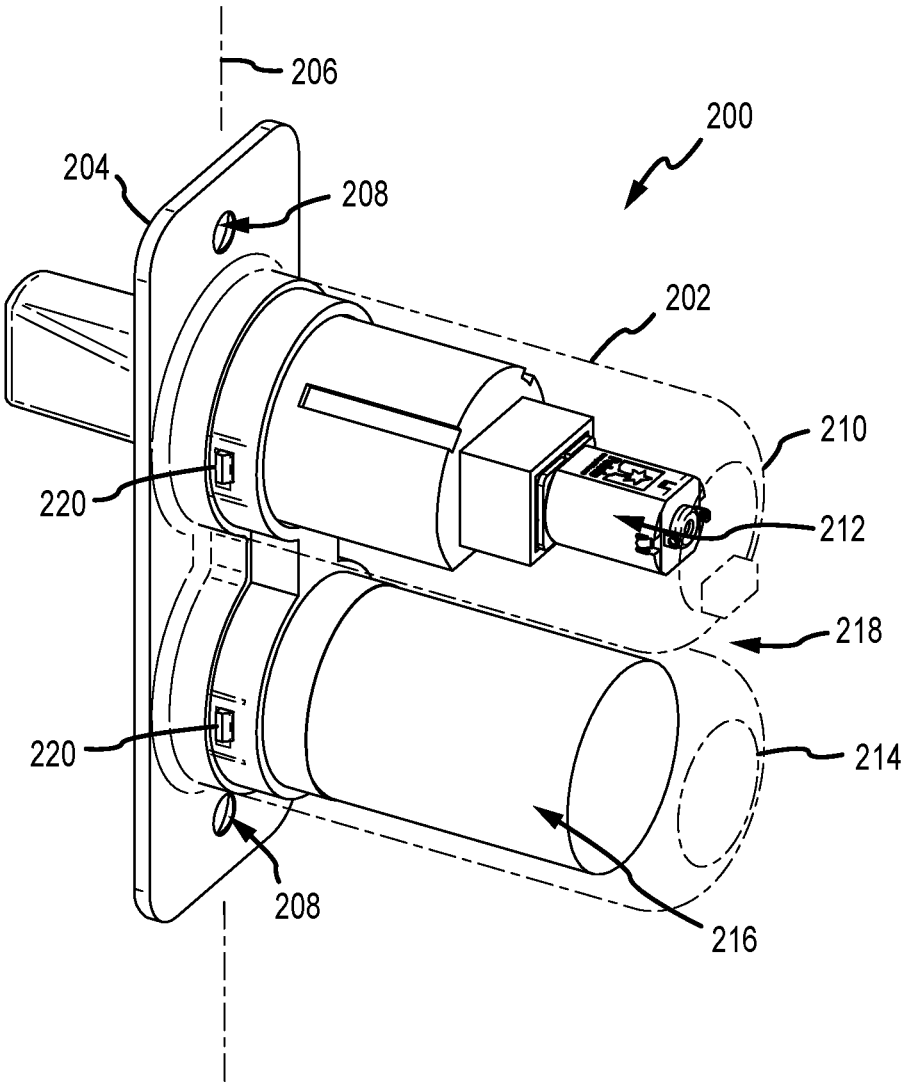
FIG. 2B is a rear perspective view of the electronic deadbolt.

FIG. 2A is a front perspective view of an exemplary electronic deadbolt 200 for use with the multi-point electric door lock system 100 (shown in FIG. 1). FIG. 2B is a rear perspective view of the electronic deadbolt 200 with a housing 202 illustrated as transparent such that the internal components are visible therein. Referring concurrently to FIGS. 2A and 2B, the electronic deadbolt 200 includes a face plate 204 extending along a longitudinal face plate axis 206. One or more apertures 208 are defined in the face plate 204 so that the face plate 204 may be secured to a door and/or frame with one or more fasteners (not shown).

The housing 202 is releasably coupled to the face plate 204 and disposed on one side thereof. The housing 202 includes a first end 209 that is configured to couple to the face plate 204 and an opposite second end 211. The housing 202 also includes a bolt compartment 210 configured to house a bolt module 212 therein, and a battery compartment 214 configured to house a battery module 216 therein. In the example, the bolt compartment 210 is separated from the battery compartment 214 proximate the second end 211 of the housing 202 such that a gap 218 is formed therebetween.

As illustrated, both the bolt compartment 210 and the battery compartment 214 are substantially cylindrical in shape and extend substantially orthogonally to the longitudinal axis 206. In the example, the bolt compartment 210 and the battery compartment 214 have approximately equal outer diameters so that a single boring tool, such as a drill, may be utilized for installation of both compartments of the electronic deadbolt 200. For example, the outer diameter may be approximately 1¼ inches in diameter. In other examples, the outer diameter may be between, and include, ½ inches and 2 inches as required or desired. In an aspect the outer diameter may correspond to standard spade drill bits (e.g., ⅞ inches, 1 inch, 1⅛ inches, etc.). In other examples, the compartments 210, 214 may have different outside diameters as required or desired. For example, the bolt compartment 210 may have an outside diameter that is smaller than, or greater than, the battery compartment 214 (e.g., for a larger power source).

The bolt compartment 210 is separated by the gap 218 extending along the longitudinal axis 206 from the battery compartment 214, such that each part of the housing 202 may be received within a corresponding and discrete bore in the door and/or frame. As described above, this enables a more efficient installation of the electronic deadbolt 200. For example, two boreholes can be drilled out from the door and/or frame by a common drill and bit so that the electronic deadbolt 200 can be installed. This reduces the need to form complex cavities (e.g., irregular shapes) in the door and/or frame for the deadbolt assembly.

In other examples, both the bolt compartment 210 and the battery compartment 214 may be combined in to a single compartment, for example, a substantially oval-shaped housing 202, with both the bolt module 212 and the battery module 216 in the same compartment space. In this example, the bolt module 212 and the battery module 216 are still stacked on top of one another. Additionally, the oval-shaped housing 202 can still increase installation efficiencies because it is easier to form an oval shape than a square housing shape in a door and/or frame.

In the example, the housing 202 may be removably coupled to the face plate 204 such that the bolt module 212 and the battery module 216 are accessible. For example, the housing 202 may be coupled to the face plate 204 by one or more snap locks 220 (e.g., a protrusion extending from the face plate and a corresponding opening defined in the housing that can be press fit together and retain the housing to the face plate). As illustrated, the bolt compartment 210 and the battery compartment 214 each has a pair of opposing snap locks 220. In other examples, the housing 202 may be coupled to the face plate 204 via any other connection method as required or desired.

Figure 3A:
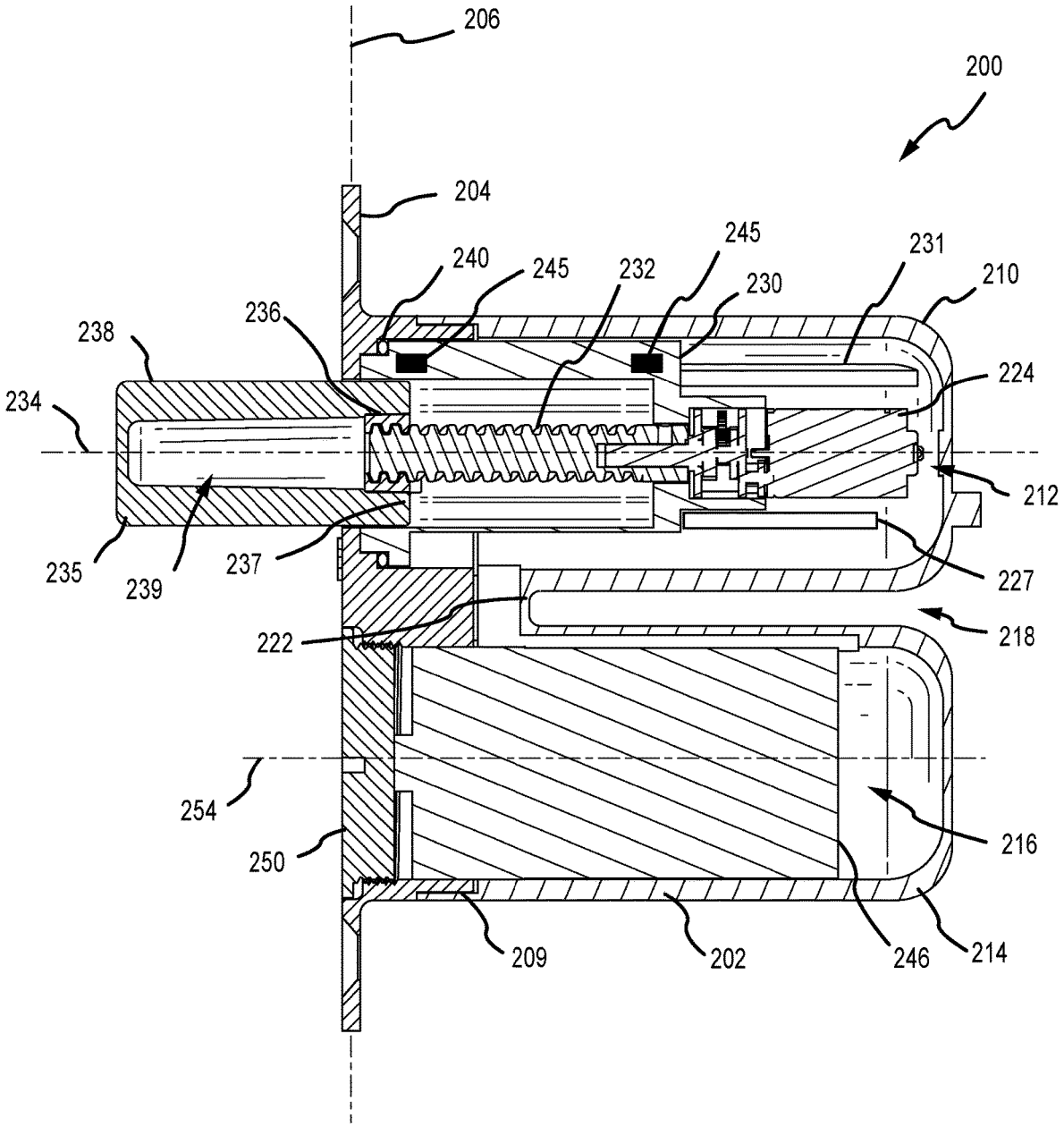
FIG. 3A is a cross-sectional view of the electronic deadbolt.
Figure 3B:
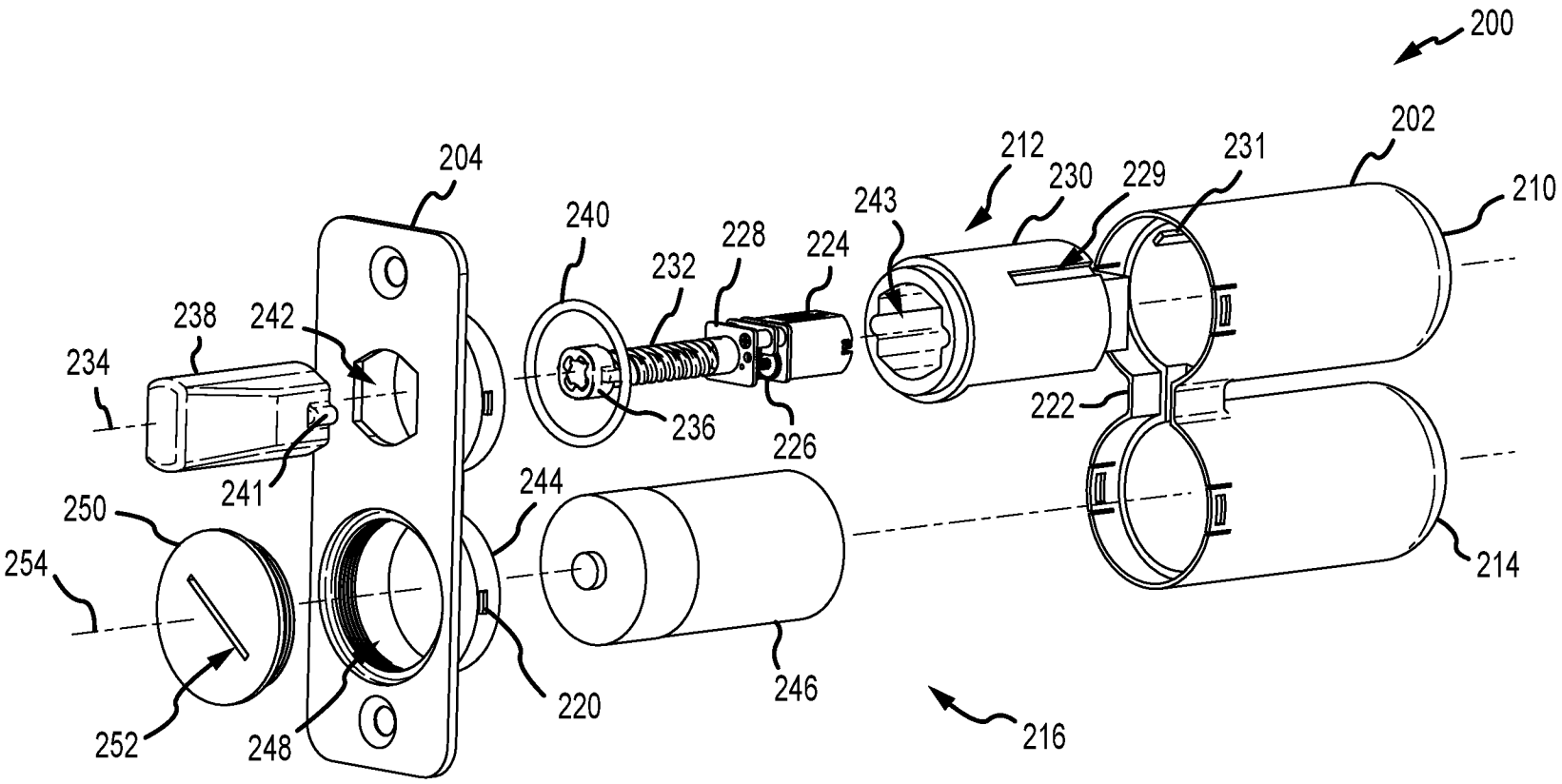
FIG. 3B is an exploded perspective view of the electronic deadbolt.

FIG. 3A is a cross-sectional view of the electronic deadbolt 200. FIG. 3B is an exploded perspective view of the electronic deadbolt 200. Referring concurrently to FIGS. 3A and 3B, the housing 202 includes the bolt compartment 210 that is stacked along the longitudinal axis 206 of the face plate 204 from the battery compartment 214. In the example, the bolt compartment 210 and the battery compartment 214 are coupled together to form a single housing unit. The bolt compartment 210 is coupled to the battery compartment 214 by a spacer 222 at the first end 209 of the housing 202 so that the gap 218 is defined therebetween. The spacer 222 can be at least partially hollow such that the two compartments 210, 214 are open to one another and the bolt module 212 disposed within the bolt compartment 210 can be electrically and/or communicatively coupled to the battery module 216 disposed within the battery compartment 214. In other examples, the bolt compartment 210 and the battery compartment 214 may be separate housing components that are each individually coupled to the face plate 204 (e.g., via a snap-fit connection, threaded connection, etc.) and the electrical/communication connection between the two modules 212, 216 may extend adjacent the face plate 204.

In the example, the bolt compartment 210 defines a bolt axis 234 and at least partially houses the bolt module 212. The bolt module 212 includes a motor 224 that is configured to drive a rotating shaft based on power provided from the battery module 216. In the example, the motor 224 may be an off-the-shelf unit that includes an integral gear set 226 surrounded by a chassis 228 and is communicatively coupled to a circuit board 227 (shown in FIG. 3A) that can control operation thereof. The bolt module 212 is at least partially supported within the bolt compartment 210 by a support 230 so as to align the motor 224 and the other components along the bolt axis 234.

The support 230 is sized and shaped to engage within the bolt compartment 210 and includes an outer surface having slots 229 that correspond to protruding channels 231 within the bolt compartment 210 such that the bolt module 212 can be circumferentially aligned within the bolt compartment 210 during assembly. Additionally, the support 230 being engaged with the bolt compartment 210 prevents the bolt module 212 from rotating within the compartment during operation (e.g., rotational movement induced by the motor 224). As described above, the bolt compartment 210 is similarly sized to the battery compartment 214 to facilitate easier installation in the door/frame, and thus, the bolt compartment 210 may be sized larger than needed for the bolt module 212. Accordingly, the support 230 also acts as a spacer to radially align the motor 224 and other components within the bolt compartment 210 and along the bolt axis 234.

The bolt module 212 also includes a lead screw 232 that is connected to the motor 224, via the gear set 226 and shaft, and is configured to be rotated about the bolt axis 234 by the motor 224. The lead screw 232 includes a nut 236 that connects the lead screw 232 to a deadbolt 238, such that rotation of the lead screw 232 around the bolt axis 234 translates into linear movement of the deadbolt 238 along the bolt axis 234. Thus, rotation of the lead screw 232 driven by the motor 224 can selectively extend and retract the deadbolt 238 from the bolt compartment 210 and the face plate 204.

The deadbolt 238 includes a first extension end 235 that is tapered for extension into a corresponding keeper to lock the door. A second end 237 of the deadbolt 238 includes a recess for securing the nut 236 to the deadbolt 238. An internal bore 239 extends from the second end 237 of the deadbolt 238 towards the first end 235 such that a portion of the lead screw 232 can extend within the deadbolt 238 during the retraction operations. In other examples, the nut 236 may be integral with the deadbolt 238. Additionally, a pair of projections 241 extend from the second end 237 of the deadbolt 238. The projections 241 are sized and shaped to be received within corresponding recesses 243 extending longitudinally within the support 230. By slidingly engaging the deadbolt 238 with the support 230, upon rotation of the lead screw 232, rotation of the deadbolt 238 is prevented so that rotational movement of the lead screw 232 is transferred into linear movement of the deadbolt 238.

The bolt module 212 also includes an O-ring 240 that is positionable between the support 230 and the face plate 204 and restricts dust and debris from accumulating within the bolt compartment 210. In the example, the face plate 204 defines a bolt opening 242 that is sized and shaped to enable the deadbolt 238 to extend and retract with respect to the face plate 204. On one side of the face plate 204, the face plate 204 includes a housing extension 244 that is shaped and sized to receive the first end 209 of the housing 202 and secure the electronic deadbolt assembly 200 together. For example, the snap locks 220 can be positioned on the housing extension 244.

In some examples, the bolt module 212 may further include a position sensor 245 (shown in FIG. 3A) that is configured to sense the position of the deadbolt 238. The face plate 204 (or any other deadbolt system component) may form a hard stop of the deadbolt 238. This hard stop defines the stroke length of the deadbolt 238 (e.g., the extension/retraction length along the bolt axis 234). That is, when the motor 224 is extending the deadbolt 238 from the face plate 204, the motor 224 rotates in a first direction until the hard stop proximate the face plate 204 contacts the deadbolt 238, thus preventing any further extension therefrom. Similarly, when the motor 224 is retracting the deadbolt 238 into the housing 202, the motor 224 rotates in an opposite second direction until the hard stop at the end of the support 230 contacts the deadbolt 238, preventing any further retraction therein. The shock loads that are introduced into the bolt module 212 from the hard stops (e.g., the motor 224 driving the deadbolt 238 into the hard stop and the continued motor drive until the system stops the extension/retraction operation) can undesirably reduce the life cycle of the bolt module. More specifically, undesirable wear is introduced into one or more components of the bolt module 212 from the hard stops and motor drive. For example, the teeth of the gear set 226 may crack and/or break due to these loads.

Accordingly, to at least partially absorb the loads generated by the hard stops and the motor drive, the position sensor 245 may be used to detect the position of the deadbolt 238 and stop, slow, and/or reverse the motor 224 before the hard stop is reached. This increases the life span of the bolt module 212 and the motor 224. The sensor 245 may be any type of switch, sensor, transducer/transformer, encoder, etc. that enables the function of the bolt module 212 as described herein. Additionally or alternatively, a flexible coupling (not shown) may be used between the motor shaft and the leadscrew so as to absorb loads before the loads reach the gear set 226 and the motor 224.

In the example, the battery compartment 214 defines a battery axis 254 and at least partially houses the battery model 216. The battery model 216 includes a power source 246 (e.g., a battery) and electrical contacts (not shown) that enable power to be extracted from the power source 246. The electrical contacts may be at least partially recessed within the battery compartment 214 such that the power source 246 may easily slide within the battery compartment 214. In the example, power source 246 may be a "D" size battery and as such, the battery compartment 214 is sized and shaped to receive one "D" battery. Although other battery types, arrangements, and power sources may be utilized as required or desired. Additionally or alternatively, the electronic deadbolt 200 may be connectable to the structure's line power that it is placed within.

The face plate 204 defines a battery opening 248 that is sized and shaped to enable the power source 246 to be inserted and removed through the face plate 204. The battery opening 248 has a removable cover 250 that provides access to the battery compartment 214 so that the bolt compartment 210 does not have to be disturbed while replacing the power source 246. The cover 250 may be cylindrically-shaped to correspond to the shape of the power source 246 and securable to the face plate 204 via a threaded connection or any other connection as required or desired. In other examples, cover 250 may have any other shape (e.g., rectangular, oval, etc.) as required or desired, and may or may not correspond to the shape of the power source 246. The cover 250 may include a slot 252 on the face of the cover 250 that enables a screwdriver or a coin to be utilized to rotate the cover 250. The cover 250 is configured to secure flush to the surface of the face plate 204 so that it does not interfere with the opening and closing of the door.

The battery compartment 214 defines the battery axis 254 along which the power source 246 is positioned along. The battery axis 254 is substantially parallel, but offset, from the bolt axis 234. Additionally, both the battery axis 254 and the bolt axis 234 are substantially orthogonal to the longitudinal axis 206 of the face plate 204. This configuration enables access to the power source 246 and extension/retraction of the deadbolt 238 via the face plate 204. Also, installation of the electronic deadbolt assembly 200 in the door is easier because the housing 202 that contains the components is shaped and size to only require two bore holes. Overall, the electronic deadbolt 200 is constructed and configured in a manner that reduces overall space, eases installation (even by untrained purchasers), for example, through use of a standard size drill bit, and limits end-user access to critical internal components (e.g., the motor and circuit board).

Figure 4:
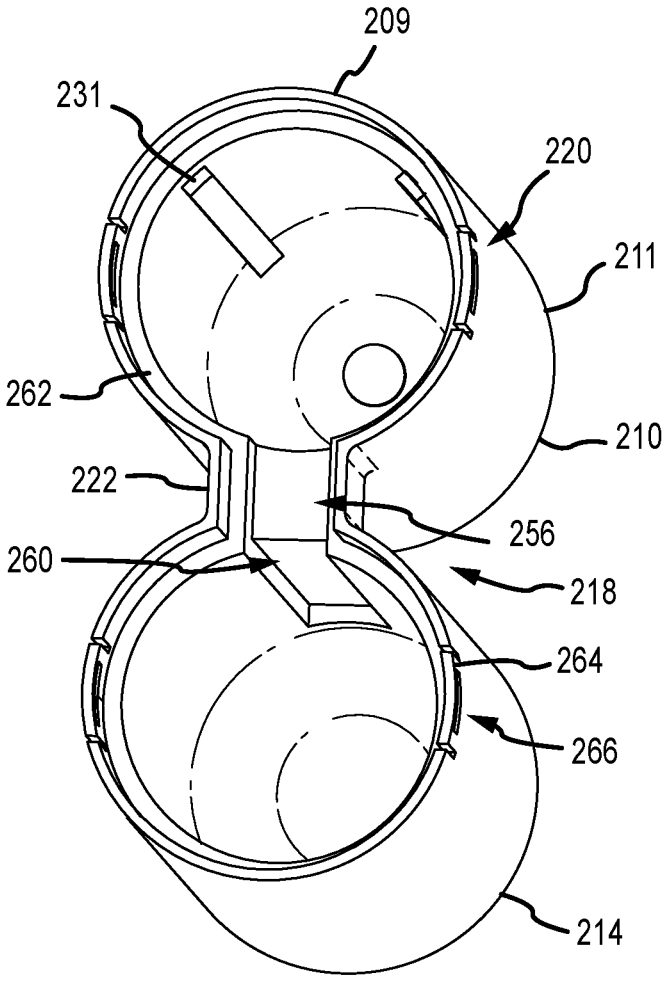
FIG. 4 is a perspective view of a housing of the electronic deadbolt.

FIG. 4 is a perspective view of the housing 202 of the electronic deadbolt 200 (shown in FIGS. 2A-3B). Certain components of the housing 202 may be described above, and thus, are not necessarily described further. The housing 202 has the first end 209 that is configured to couple to the face plate 204 (shown in FIGS. 2A and 2B). The first end 209 is open so that both the bolt compartment 210 and the battery compartment 214 are formed. However, the compartments 210 and 214 independent and discrete from one another. As such, between the compartments 210, 214 is the spacer 222 so that the bolt compartment 210 and the battery compartment 214 are a single unitary component. In other examples, the bolt compartment 210 and the battery compartment 214 may be separate components as required or desired. The spacer 222 has an open notch 256 that extends between the two compartments 210, 214 so that connection components between the bolt module and the battery module may pass therebetween as required or desired. The second end 211 of the housing is enclosed to so that the components of the bolt and battery modules can be fully enclosed.

The bolt compartment 210 includes one or more protruding channels 231 such that the support 230 (shown in FIGS. 3A and 3B) can be engaged within the bolt compartment 210 as described above. In the example, the channels 231 may be positioned at the top of the bolt compartment 210 so that the bottom of the bolt compartment 210 has space for components of the bolt module (e.g., the circuit board 227 (shown in FIG. 3A)). The battery compartment 214 includes a recess 260 defined therein so that the electrical contacts for the power source may be positioned within the battery compartment 214. In the example, the recess 260 may be positioned at the top of the battery compartment so that the contacts are closer to the bolt module.

Around a perimeter of the first end 209 of the housing 202, a lip 262 is defined so that the housing 202 may be secured around the housing extension 244 of the face plate 204 (shown in FIG. 3B) as described above. In the example, the lip 262 extends around the entire perimeter of the first end 209 so as to increase the structural rigidity of the housing 202 and face plate 204 connection. Additionally, the snap lock connection 220 defined on the housing 202 may include a resilient arm 264 with an opening 266 defined therein to engage with a corresponding protrusion 270 on the face plate 204 (shown in FIG. 5). In other examples, the bolt compartment 210 and the battery compartment 214 may have similar internal features so that the housing 202 is symmetrical and the orientation of the bolt compartment 210 and the battery compartment 214 does not matter when attaching the housing 202 to the face plate 204.

Figure 5:
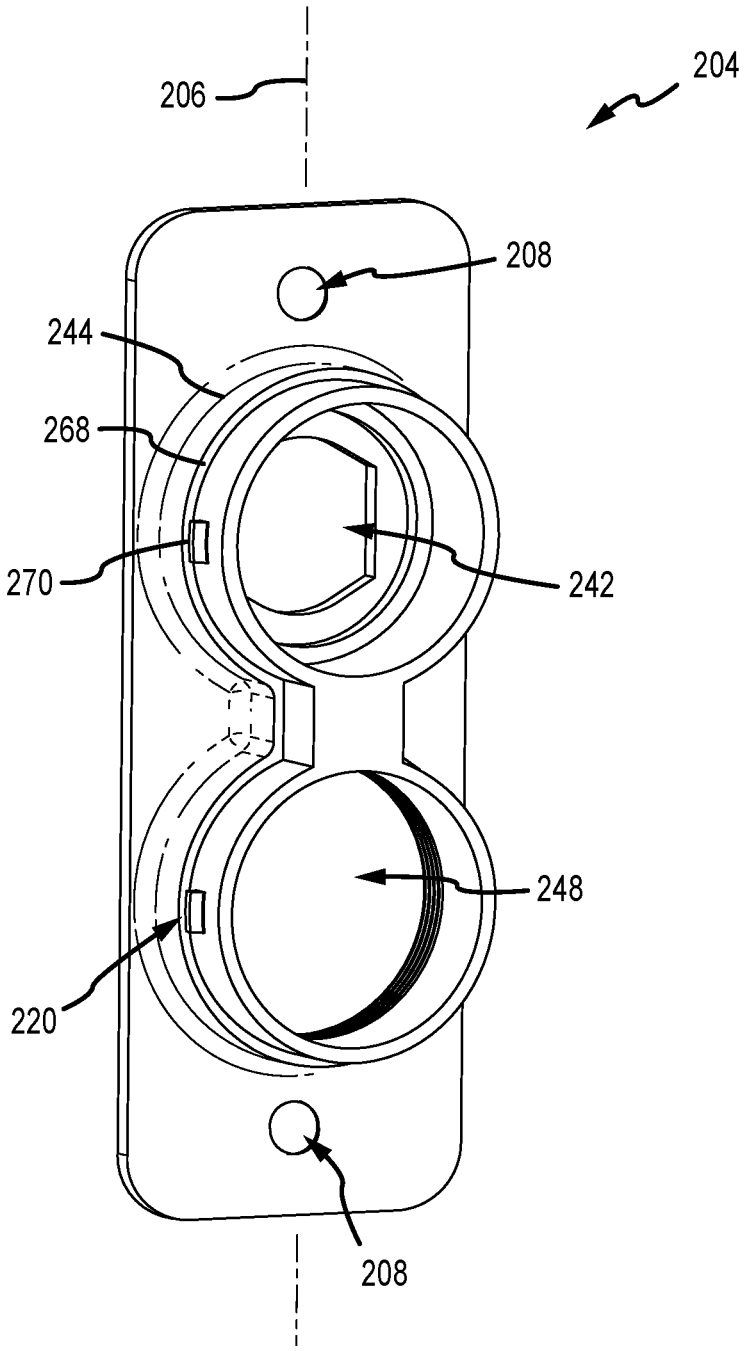
FIG. 5 is a perspective view of a face plate of the electronic deadbolt.

FIG. 5 is a perspective view of the face plate 204 of the electronic deadbolt 200 (shown in FIGS. 2A-3A). Certain components of the face plate 204 may be described above, and thus, are not necessarily described further. The face plate 204 defines a bolt opening 242 and a battery opening 248 substantially aligned along the longitudinal axis 206. The bolt opening 242 is sized and shaped to correspond to the deadbolt 238 (shown in FIGS. 3A and 3B) and the battery opening 248 is sized and shaped to correspond to the power source 246 (shown in FIGS. 3A and 3B). As such, the bolt opening 242 has a different size and shape than the battery opening 248. In other examples, the bolt opening 242 and the battery opening 248 may be substantially similar in size and/or shape. The battery opening 248 also includes internal threads so that the cover 250 (shown in FIGS. 3A and 3B) can be secured to the face plate 204.

In addition, the housing extension 244 extends from one side and includes a shoulder 268 that is configured to be received at least partially within the lip 262 of the housing 202 (shown in FIG. 4). In some examples, the shoulder 268 around bolt opening 242 may be separate from the shoulder 268 around the battery opening 248 so that individual bolt and battery compartments 210, 214 can be coupled thereto. To secure the face plate 204 to the housing 202, the snap lock connection 220 defined on the face plate 204 may include a protrusion 270 that is configured to engage with a corresponding opening 266 on the housing 202 (shown in FIG. 4).

Figure 6:
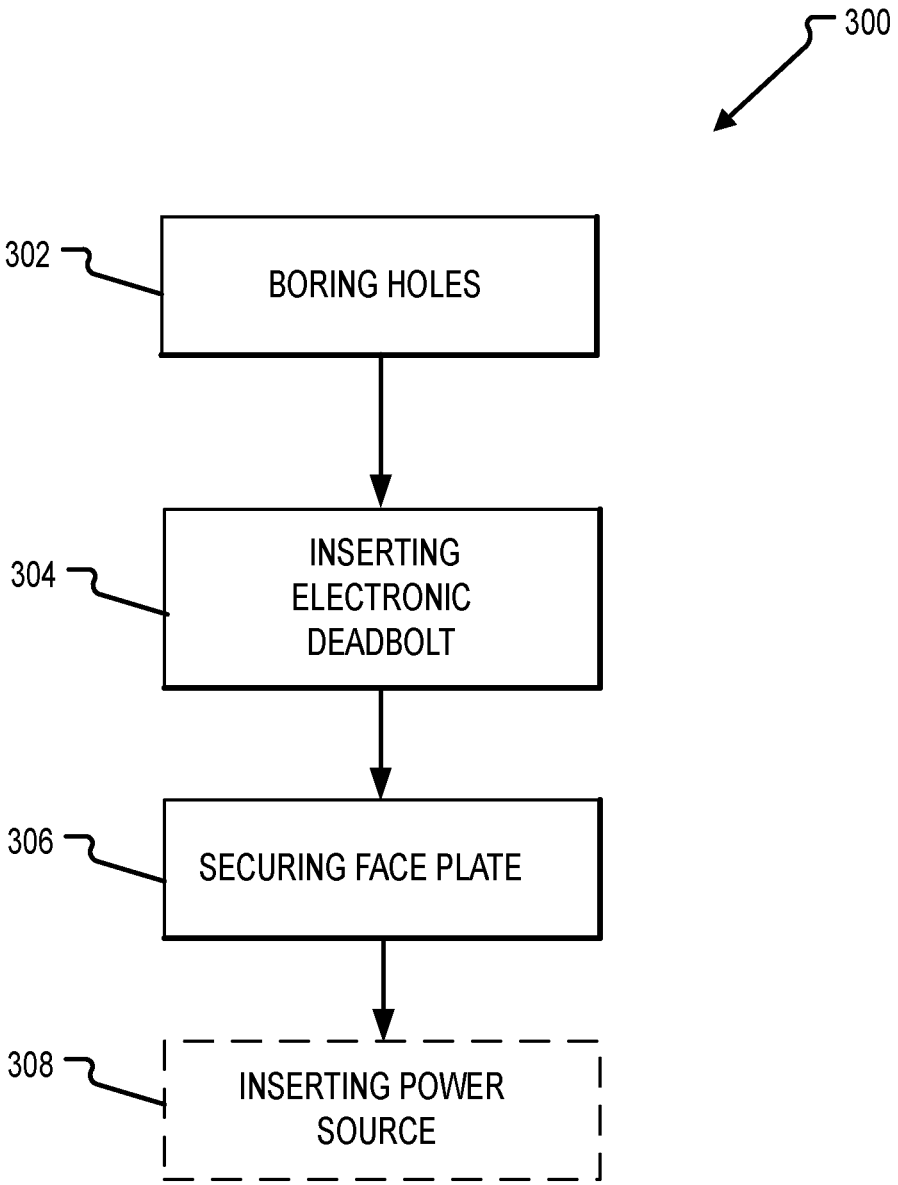
FIG. 6 is a flowchart illustrating an exemplary method of installing an electronic deadbolt.

FIG. 6 is a flowchart illustrating an exemplary method 300 of installing an electronic deadbolt. The method 300 includes boring two substantially cylindrical holes adjacent to one another on the door (operation 302). Then at least a portion of the electronic deadbolt can be inserted into the two cylindrical holes (operation 304). The electronic deadbolt may include a face plate and a housing having a bolt compartment and a battery compartment such that each compartment is inserted within a respective hole. A bolt module can be disposed within the bolt compartment and a battery module can be disposed within the battery compartment of the electronic deadbolt similar to the examples described herein. The face plate can then be secured to the door (operation 306). For example, by one or more fasteners at the top and bottom of the face plate. In some examples, the method 300 may further include inserting a power source into the battery compartment (operation 308). For example, by a removable cover that attaches to the face plate.

The materials utilized in the manufacture of the lock described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.).

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An electronic deadbolt comprising:

a face plate;

a housing comprising a first end and an opposite second end, wherein the first end is releasably coupled to the face plate, wherein the housing further comprises a bolt compartment defining a bolt axis and a battery compartment defining a battery axis, and wherein the bolt axis is substantially parallel to and offset from the battery axis, and the bolt compartment is separated from the battery compartment proximate the second end of the housing; and a bolt module disposed within the bolt compartment, wherein the bolt module comprises a motor and a deadbolt, and wherein the deadbolt is configured to be selectively linearly extended from the face plate along the bolt axis.

2. The electronic deadbolt of claim 1, wherein both of the bolt compartment and the battery compartment are substantially cylindrical.

3. The electronic deadbolt of claim 2, wherein the bolt compartment has a first outer diameter and the battery compartment has a second outer diameter, and wherein the first outer diameter is approximately equal to the second outer diameter.

4. The electronic deadbolt of claim 2, wherein the bolt compartment and the battery compartment are approximately 1¼ inches in diameter.

5. The electronic deadbolt of claim 1, wherein the housing further comprises a spacer disposed at least partially between the bolt compartment and the battery compartment at the first end.

6. The electronic deadbolt of claim 1, wherein the bolt module further comprises a lead screw configured to be rotated by the motor about the bolt axis, and wherein the deadbolt is coupled to the lead screw.

7. The electronic deadbolt of claim 6, wherein the bolt module further comprises a support coupled to an inside surface of the bolt compartment, wherein the support is engaged with the deadbolt such that upon rotation of the lead screw, rotation of the deadbolt is prevented so that rotational movement of the lead screw is transferred into linear movement of the deadbolt.

8. The electronic deadbolt of claim 7, wherein the support at least partially supports the motor and the deadbolt within the bolt compartment.

9. The electronic deadbolt of claim 1, further comprising a substantially cylindrical cover threadably coupled to the face plate adjacent the battery compartment.

10. An electronic deadbolt comprising:

a bolt compartment having a bolt axis and configured to house a bolt module, wherein the bolt module comprises:

a motor;

a lead screw configured to be rotated by the motor about the bolt axis; and a deadbolt coupled to the lead screw and upon rotation of the lead screw, is linearly extendable from the bolt compartment along the bolt axis;

a battery compartment having a battery axis and configured to house a battery module, wherein the bolt axis is substantially parallel to and offset from the battery axis; and a face plate releasably coupled to the bolt compartment and the battery compartment.

11. The electronic deadbolt of claim 10, wherein the bolt compartment and the battery compartment are coupled together to form a single housing.

12. The electronic deadbolt of claim 11, wherein at least a portion of the bolt compartment and the battery compartment are separated by a gap.

13. The electronic deadbolt of claim 10, wherein both of the bolt compartment and the battery compartment are substantially cylindrical.

14. The electronic deadbolt of claim 13, wherein the bolt compartment has a first outer diameter and the battery compartment has a second outer diameter, and wherein the first outer diameter is approximately equal to the second outer diameter.

15. The electronic deadbolt of claim 13, wherein the bolt compartment is independent from the battery compartment.

16. The electronic deadbolt of claim 10, wherein the face plate comprises a shoulder extending therefrom and the compartments comprise a lip, and wherein when the compartments are coupled to the face plate the shoulder engages with the lip.

17. The electronic deadbolt of claim 10, wherein the bolt compartment and the battery compartment are coupled to the face plate with a snap-fit connection.

18. The electronic deadbolt of claim 10, wherein the bolt module further comprises a position sensor.

19. A method of installing an electronic deadbolt on a door, the method comprising:

boring two substantially cylindrical holes adjacent to one another on the door;

inserting at least a portion of the electronic deadbolt into the two cylindrical holes, wherein the electronic deadbolt includes a face plate and a housing including a bolt compartment and a battery compartment, wherein each compartment is inserted within a respective hole, and wherein a bolt module is disposed within the bolt compartment and a battery module is disposed within the battery compartment; and securing the face plate to the door.

20. The method of claim 19, further comprising inserting a power source into the battery compartment.

* * * * *